US009435318B2

(12) United States Patent
Kreuger

(10) Patent No.: US 9,435,318 B2
(45) **Date of Patent: *Sep. 6, 2016**

(54) LIQUID RING SYSTEM AND APPLICATIONS THEREOF

(71) Applicant: Sten Kreuger, Chonburi (TH)

(72) Inventor: Sten Kreuger, Chonburi (TH)

( * ) Notice: Subject to any disclaimer, the term of this patent is extended or adjusted under 35 U.S.C. 154(b) by 264 days.

This patent is subject to a terminal disclaimer.

(21) Appl. No.: 14/251,497

(22) Filed: Apr. 11, 2014

(65) Prior Publication Data

US 2014/0216028 A1 Aug. 7, 2014

Related U.S. Application Data

(63) Continuation of application No. 13/844,593, filed on Mar. 15, 2013, now Pat. No. 8,695,335.

(60) Provisional application No. 61/729,471, filed on Nov. 23, 2012.

(51) Int. Cl.

| | |
|---|---|
| ***F03C 1/00*** | (2006.01) |
| ***F03C 1/02*** | (2006.01) |
| ***F03C 1/36*** | (2006.01) |
| ***F03C 1/14*** | (2006.01) |
| ***F01C 7/00*** | (2006.01) |

(52) U.S. Cl.
CPC *F03C 1/002* (2013.01); *F01C 7/00* (2013.01)

(58) Field of Classification Search
CPC ..... F01C 7/00; F03C 1/00; F03C 1/002
USPC ..... 60/527, 525, 530
See application file for complete search history.

(56) References Cited

U.S. PATENT DOCUMENTS

| | | | | |
|---|---|---|---|---|
| 3,240,017 | A * | 3/1966 | Boissevain | F01C 7/00 123/234 |
| 3,275,222 | A * | 9/1966 | Meyer | F01C 7/00 123/204 |
| 5,195,321 | A * | 3/1993 | Howard | F01B 21/00 60/517 |
| 5,251,593 | A | 10/1993 | Pedersen | |
| 5,636,523 | A | 6/1997 | Assaf | |
| 7,171,811 | B1 | 2/2007 | Berchowitz et al. | |
| 2008/0314041 | A1 | 12/2008 | Assaf | |
| 2009/0126562 | A1 | 5/2009 | Nickl | |

FOREIGN PATENT DOCUMENTS

| | | | |
|---|---|---|---|
| WO | 2009112029 | A1 | 9/2009 |
| WO | 2010071651 | A1 | 6/2010 |
| WO | 2012071538 | A2 | 5/2012 |

* cited by examiner

*Primary Examiner* — Kenneth Bomberg
*Assistant Examiner* — Deming Wan
(74) *Attorney, Agent, or Firm* — Andrew D. Fortney; Central California IP Group, P.C.

(57) ABSTRACT

The present disclosure concerns liquid ring systems, including (i) a fixed or rotating casing adapted to contain a liquid, (ii) a rotor located within the casing and having at least one impeller, (iii) a liquid ring formed by rotation of the rotor or the casing, and (iv) a plurality of gas cells formed between the inner surface of the liquid ring and vanes of the impeller. For example, at least one compressing gas cell is in fluid connection with at least one expanding gas cell integrated with the rotor. A liquid valve may include a small gas cell with a reciprocating liquid surface and at least two fluid connections having a free pathway between the connections during an angle of rotation of the rotor and a closed pathway between the connections during 360° minus the angle of rotation.

20 Claims, 10 Drawing Sheets

2
50b
10b
1b
12b
4b
11b
7

2
13
50b
25b
(y)
(x')
15
19
22
10b
B
7
9
5
6
A
3
21
23
16
(x)
42
25a
50a
4
18
10a
20a
A
B 11a
12a
10a
1a
4a
50a
2
6

4
11b
10b
12b
1b
14
25b
3
2
16
13
H
7
9
G
6
25a
(y)
(x, x')
10a
1a
11a
12a
24

11b
10b
12b
1b 25b
4
10b
2
3
13
J
J
8
9b
7
9a
I
I
6
25a
(y)
(x, x')
14
12a 10a
11a
12a
1a 4
4
8
10
14
4

LIQUID RING SYSTEM AND APPLICATIONS THEREOF

CROSS REFERENCES TO RELATED APPLICATIONS

This application is a continuation of U.S. patent application Ser. No. 13/844,593, filed Mar. 15, 2013, which claims the benefit of U.S. Provisional Patent Application No. 61/729,471, filed Nov. 23, 2012, each of which is incorporated herein by reference in their entireties.

BACKGROUND OF THE INVENTION

The present invention generally relates to a system of liquid ring devices for use in applications such as heat engines, heat pumps and pressure swing adsorption (PSA). In particular, the liquid ring system comprises a casing containing a liquid, a rotor mounted inside the casing and comprising at least one impeller, a liquid ring formed by rotation of the rotor or the casing, a plurality of gas cells formed between the inner surface of the liquid ring and vanes of the impeller, and a fluid connection for example between at least one compressing gas cell and at least one expanding gas cell, integrated with the rotor.

The liquid ring device is known in the prior art, with the principle existing as early as in U.S. Pat. No. 953,222 to Nash in 1910. The first application of the device was found in U.S. Pat. No. 1,094,919 to Nash in 1914 that disclosed a turbo-displacement engine based on a liquid ring device. Thus far, a number of developments based on liquid ring systems have been disclosed, with more than 400 US patents being issued for various applications, such as heat engines, heat pumps and gas compressors.

Generally, a liquid ring device comprises a casing, a rotating vaned impeller eccentrically located within the casing, an inlet port for a gas supply in the end of the casing and an outlet port for a gas discharge in the other end of the casing. During the operation, a liquid is fed into the casing and, due to the rotation of the impeller, the liquid forms a liquid ring against the inside wall of the casing. The gas is trapped within cells formed between the vanes of the impeller and the surface of the liquid, and as a result of the impeller rotation and the eccentricity between the impeller rotation axis and the casing axis, the gas volume in the cells is alternatively reduced and enlarged, which causes compression and expansion of the gas.

Current applications of the liquid ring system mainly include vacuum pumps and gas compressors. The Stirling engine is advantageous in that any type of liquid fuel can be used in the engine; however, an expensive cost of construction, a complex design and a short interval of service (e.g., due to sealing overhauls) are considered as drawbacks of the conventional Stirling engines.

The liquid ring system according to the present invention can be applied to Stirling engines as well as other heat engines, such as Rankin engines, Brayton engines, open-cycle Stirling engines, and for PSA applications, with fewer moving parts compared to the conventional Stirling engines and with liquids as sealings. Thus, a longer interval of service can be achieved. Further, the liquid ring system of the present invention facilitates the use of a liquid salt as the liquid ring, which provides for an increased efficiency compared to the conventional liquid ring system.

SUMMARY OF THE INVENTION

It is an object of the present invention to provide a liquid ring system, which can be applied to Stirling-type engines, Brayton-type engines, or for PSA applications.

It is a further object of the invention to provide a liquid port valve for controlling a flow of fluid.

BRIEF DESCRIPTION OF THE DRAWINGS

FIG. 1 shows a first embodiment of a liquid ring system according to the invention with two liquid-ring chambers arranged eccentrically to each other, adapted for application to a Brayton-type engine or heat pump.

FIG. 2 shows a second embodiment of a liquid ring system according to the invention with two liquid-ring chambers arranged coaxially to each other, adapted for application to a Brayton-type engine or heat pump.

FIG. 3 shows a third embodiment of a liquid ring system according to the invention with two liquid-ring chambers arranged coaxially to each other and fluid connections extending along and around the axis of a rotor shaft, adapted for application to a Brayton-type engine or heat pump.

FIG. 5 shows a fifth embodiment of a liquid ring system according to the invention with two liquid-ring chambers arranged eccentrically to each other, adapted for application to a Stirling-type engine.

FIG. 6 shows a sixth embodiment of a liquid ring system according to the invention with two liquid-ring chambers arranged coaxially to each other and fluid connections at a 90° phase difference extending along and helically around the axis of a rotor shaft, adapted for application to a Stirling-type engine.

FIG. 7 shows a seventh embodiment of a liquid ring system according to the invention with three liquid-ring chambers arranged coaxially to each other and fluid connections at a 90° phase difference extending along and helically around the axis of a rotor shaft, adapted for application to a Stirling-type engine or a Vuilleumier heat pump.

FIG. 8 shows an eighth embodiment of a liquid ring system according to the invention with two liquid-ring chambers arranged coaxially to each other, adapted for application to an open-cycle Stirling-type engine including an extended heat source.

FIG. 9 shows a ninth embodiment of a liquid ring system according to the invention with one liquid-ring chamber, adapted for PSA applications.

FIG. 10 shows a tenth embodiment of a liquid ring system according to the invention, adapted for application as liquid port valves.

DETAILED DESCRIPTION OF THE PREFERRED EMBODIMENTS

In a first object of the present invention, there are provided liquid ring systems, comprising (i) a fixed or rotating casing adapted to contain a liquid, (ii) a rotor located within the casing and comprising at least one impeller, (iii) a liquid ring formed by rotation of the rotor or the casing, (iv) a plurality of gas cells formed between the inner surface of the liquid ring and vanes of the impeller, characterized for example in that at least one compressing gas cell is in fluid connection with at least one expanding gas cell integrated with the rotor.

Further, a second object of the present invention can be attained by providing a liquid valve comprising a small gas cell with a reciprocating liquid surface and at least two fluid connections having a free pathway between the connections at a first angle of rotation of said rotor and a closed pathway between the connections at a second angle equal to 360° minus said first angle.

The invention will now be described using preferred embodiments with reference to the following detailed description of the Drawings and claims.

Figures 1A, 1B, 1C:
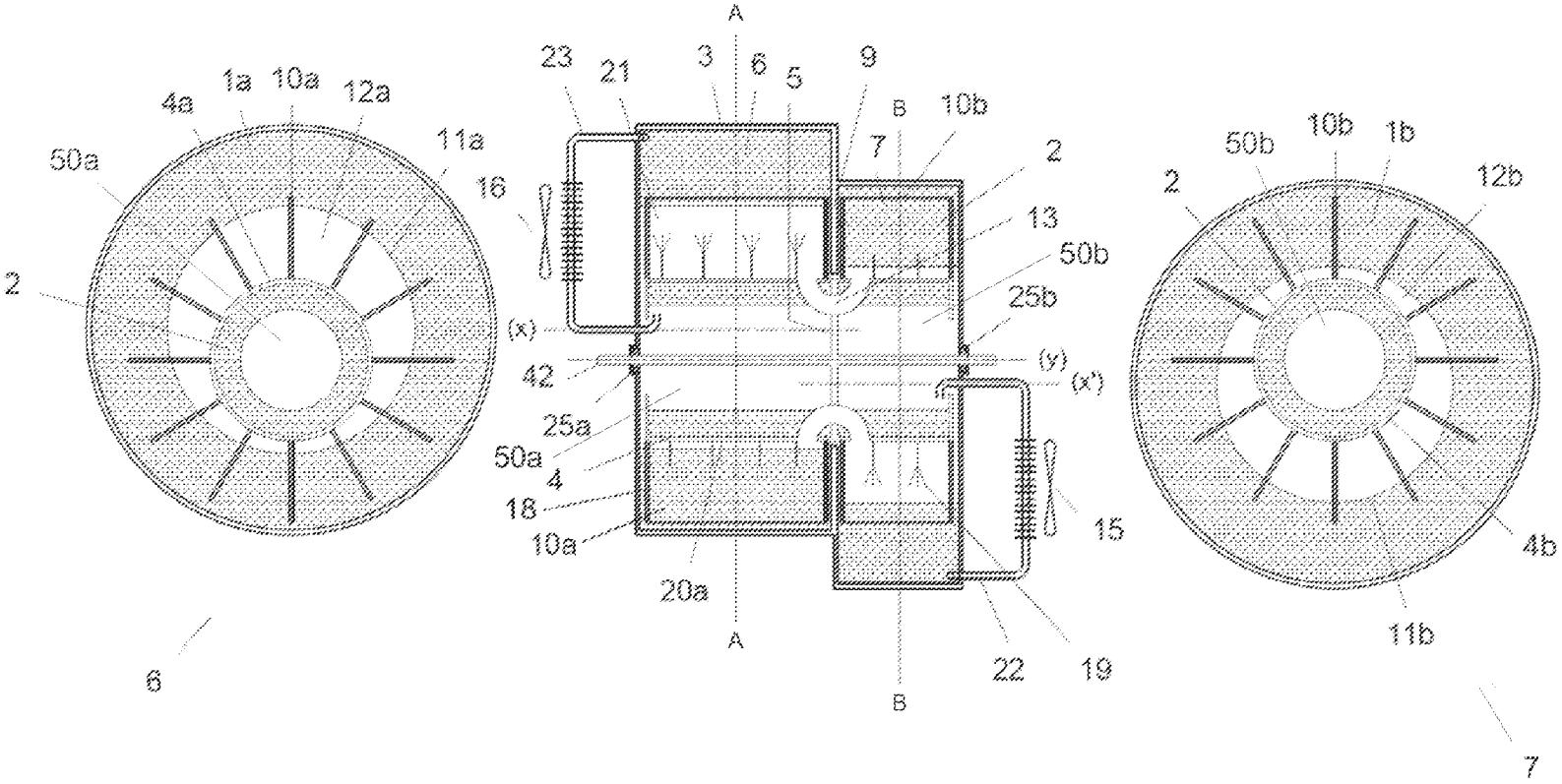
FIG. 1(A) shows a side view.
FIG. 1(B) shows a cross-sectional view along the A-A line.
FIG. 1(C) shows a cross-sectional view along the B-B line.

FIGS. 1A-C show a first embodiment of a liquid ring device 1, which in one embodiment may operate or function as a liquid ring heat pump or heat engine. FIG. 1A shows a cross-sectional view of the liquid ring device 1. The liquid ring device 1 comprises a housing 3 comprising a cylindrical part defining a first cylindrical chamber 6 and a second cylindrical chamber 7. The first and second cylindrical chambers 6 and 7 are separated by a common wall 9. The first cylindrical chamber 6 has a symmetrical axis x, and the second cylindrical chamber 7 has a symmetrical axis x', in which the symmetrical axes x and x' are displaced from each other. A rotor 4 is arranged to be rotatable in the housing 3 around an axis of rotation y and supported in the housing 3 by first and second bearings 25*a* and 25*b*. The axis of rotation y is situated halfway between the symmetrical axes x and x' of the cylindrical chambers. The rotor 4 comprises an elongated cylindrical body extending between the first and second cylindrical chambers 6 and 7 and through a circular opening in the wall 9, thereby defining a first portion 4*a* of the rotor 4 in the first cylindrical chamber 6, and a second portion 4*b* of the rotor 4 in the second cylindrical chamber 7.

FIG. 1B shows a cross-sectional view of the rotor 4 and the first cylindrical chamber 6 perpendicular to the first symmetrical axis x along the A-A line of FIG. 1A. The rotor 4 comprises a plurality of first impeller blades 10*a* connected to the first portion 4*a* of the rotor 4. The first impeller blades 10*a* extend radially from the elongated cylindrical body of the rotor 4 and may be distributed evenly around its circumference. In the example shown, there are twelve impeller blades 10*a* defining twelve cells 12 therebetween in the first cylindrical chamber 6, although any number of blades of at least 2 (e.g., 2, 3, 4, 5, 6, 7, 8, etc.) may be sufficient. At each end of the plurality of the first impeller blades 10 along the axis of rotation y, a first set of end plates 18 are arranged to enclose the cells 12*a* in an axial direction.

FIG. 1C shows a cross-sectional view of the rotor 4 and the second cylindrical chamber 7 perpendicular to the second symmetrical axis x' along the B-B line. The rotor 4 further comprises a plurality of second impeller blades 10*b* connected to the second portion 4*b* of the rotor 4. The second impeller blades 10*b* extend radially from the elongated cylindrical body of the rotor 4 and are distributed evenly around its circumference. In the example shown, there are twelve impeller blades 10*b* defining twelve cells 12*b* therebetween in the second cylindrical chamber 7, although any number of blades of at least 2 (e.g., 2, 3, 4, 5, 6, 7, 8, etc.) may be sufficient. At each end of the plurality of second impeller blades 10*b* along the axis of rotation y, a second set of end plates are arranged to enclose the cells 12*b* in an axial direction.

Each cell 12*a* in the first cylindrical chamber 6 (FIG. 1B) is connected to a corresponding cell 12*b* in the second cylindrical chamber 7 (FIG. 1C) by means of a passage 13 (FIG. 1A) defined axially in the cylindrical body of the rotor 4. Thus, the number of passages 13 in the cylindrical body of the rotor 4 is also twelve in the example shown, and it generally matches or corresponds to the number of cells, normally in a ratio of from 1/1 to 1/6. During operation, the first and second cylindrical chambers 6 and 7 comprise or contain a fluid, such as water and/or air. The rotor 4 is rotated, and the fluid 2 in the first and second cylindrical chambers 6 and 7 is brought into rotation by the first and second impeller blades 10*a* and 10*b*, respectively. The liquid in the first and second cylindrical chambers 6 and 7 then forms first and second liquid rings 1*a* and 1*b* (FIGS. 1B and 1C) in the first and second cylindrical chamber 6 and 7, respectively, by centrifugal force(s). The first and second liquid rings 1*a-b* define first and second free fluid surfaces 11*a-b*, facing inwardly towards the axis of symmetry x and x' of the respective cylindrical chambers 6 and 7. The amount of fluid in each chamber 6 and 7, and the radial extent of the impeller blades 10*a-b*, is such that the impeller blades 10*a-b* extend into the liquid rings 11*a-b* in each chamber 6 and 7, respectively, at all positions around the rotor 4 and at all rotational positions of the rotor 4. Thus, the volume of each cell 12*a* in the first cylindrical chamber 6 is delimited by the adjacent impeller blades 10*a*, the first and second end plates, and the first free fluid surface 11*a*. This volume contains gas. Correspondingly, the gas volume of each cell 12*b* in the second cylindrical chamber 7 is delimited by the adjacent impeller blades 10*b*, the first and second end plates, and the second free fluid surface 11*b*.

Since the rotational axis y of the rotor 4 is displaced from the symmetrical axes x and x' of the cylindrical chambers 6 and 7, the gas volume of each cell 12*a-b* will vary periodically with the position of the free fluid surface 11*a-b* (FIGS. 1B and 1C) with respect to the impeller blades 10*a-b* over a revolution of the rotor 4 relative to the housing 3. Depending on the various configurations of the embodiments described, the variance of the gas volume of the cells 12*a* in the first cylindrical chamber 6 and the variance of the gas volume of the cells 12*b* in the second cylindrical chamber 7 with which the cells 12*a* in the first cylindrical chamber 6 are in fluid connection, will follow each other by a phase difference a.

In the embodiment according to FIGS. 1A-C, the phase difference is 180° since the cells of the first and second cylindrical chambers 6-7 are in fluidic connection by axial passages 13, and the respective axes of symmetry of the first and second cylindrical chambers 6-7 are displaced from each other with the rotational axis y of the rotor arranged between the axes of symmetry.

In the example shown in FIG. 1A, the cylindrical body of the rotor 4 defines first and second cylindrical rotor chambers 50*a* and 50*b* inside the rotor 4, divided by a rotor wall 5. The end plates of the rotor 4 extend radially inwardly to form end plates of the first and second cylindrical rotor chambers, such that the rotor chambers may comprise or contain fluid during operation of the device in the rotor chambers under the influence of centrifugal force(s). The liquid ring device 1 comprises first and second pumps or pumping means 23, 22 arranged to transfer fluid from the liquid rings 11*a-b* (FIGS. 1B and 1C) to the rotor chambers during operation. From the rotor chambers, nozzles 19 extend through the elongated cylindrical rotor body for spraying fluid from the rotor chambers into each cell 12*a-b* (FIGS. 1B and 1C). The spraying of fluid is driven by centrifugal force(s) acting on the liquid during rotation of the rotor 4. The purpose of spraying liquid into the gas in the cells is to enhance transfer of heat between the fluid and the gas in the volume of each cell 12*a-b*.

In an alternative embodiment, or in addition to the rotor chambers and nozzles, the rotor 4 may comprise heat conducting plates in the form of lamellas in each cell 12*a-b*, extending radially outwardly from the cylindrical rotor body, to increase the surface area of the rotor 4 in each cell 12*a-b* and enhance transfer of heat between the fluid in the chamber and the gas in the volume of each cell 12*a-b*.

The first and second cylindrical chambers 6, 7 are connected to first and second external heat exchangers 16, 15 for adding heat to or removing heat from the fluid in the respective chamber 6, 7. In the example shown, the external heat exchangers are connected to the first and second pumps or pumping means 23, 22 arranged to transfer liquid from the liquid rings 1*a-b* to the rotor chambers.

Figure 2B:
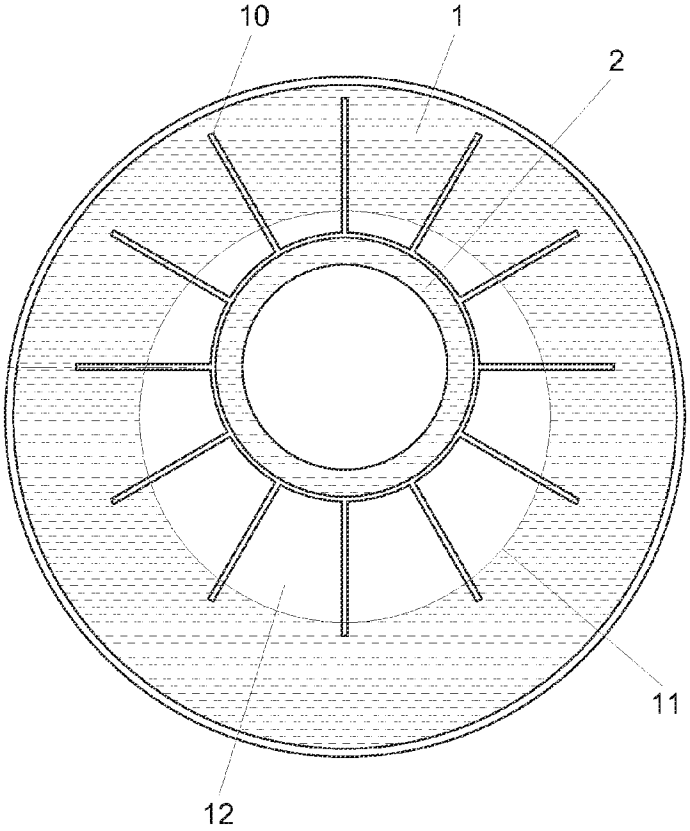
FIG. 2(B) shows a cross-sectional view along the C-C line.
Figure 2A:
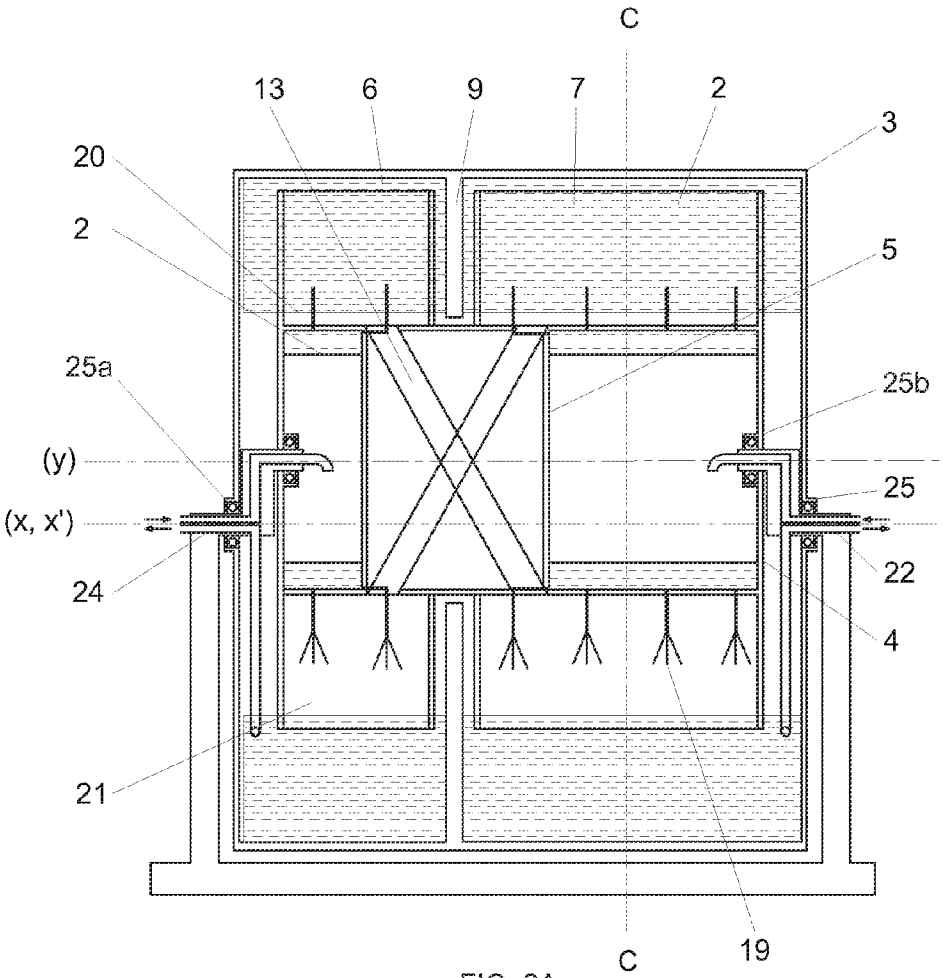
FIG. 2(A) shows a side view.

FIG. 2 shows a second embodiment of the liquid ring system adapted for application to a Brayton-type engine or heat pump. FIG. 2A shows a side view of the liquid ring system. A first chamber 6 and a second chamber 7 are coaxial to each other and separated by a chamber wall 9. A rotor 4 is mounted inside a casing 3 with a rotor wall 5. Within the chamber of the rotor 4, a fluid connection 13 is made in such a way that makes it possible for creating a phase difference different from those of FIG. 1A, FIG. 1B and FIG. 1C. Either the casing 3, the rotor 4, or both the casing 3 and the rotor 4 may be rotated. The first chamber 6 is the hot side of the liquid ring system. A gas sealed in a compressing gas cell 12*a* in the first chamber 6 is delivered to an expanding gas cell 12*b* in the second chamber 7 via the fluid connection 13 at a phase difference of 180°. The second chamber 7 is the cold side of the liquid ring system. The movement of the gas in the fluid connection 13 is similar to a heat pump. As the rotor 4 rotates, a fluid can be sprayed through spray nozzles 19. FIG. 2B shows a cross-sectional view of the liquid ring system along the C-C line. A plurality of gas cells 12 are formed between impeller vanes 10 and a liquid ring 1. As shown in FIG. 2B, the gas cells 12 are defined in part by the inner surface 11 of the liquid ring 1.

Another crucial element is the half cycle expander. This implies several advantages, one of which is that compression or expansion is done during the whole 360° cycle of the rotor 4 by a cell in fluid connection with at least one other cell, managed by the liquid ports (e.g., 24*a-d*) that open 180° and close 180° of the 360° cycle of the rotor 4. That is, when one cell ends the filling cycle, the liquid port opens the fluid connection to another cell that is just starting the filling cycle. The same phenomenon applies to compressing cells in fluid connection with another cell, the difference being that emptying cycles are used.

Figure 3B:
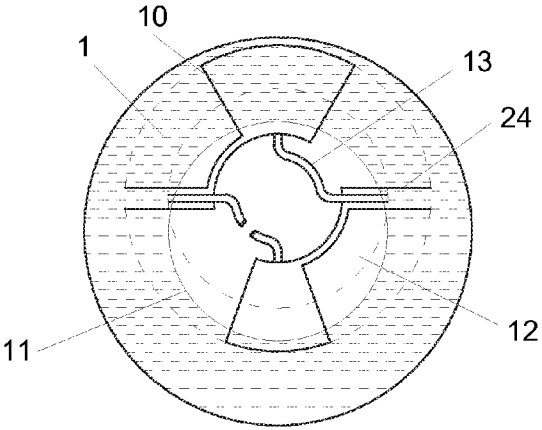
FIG. 3(B) shows a cross-sectional view along the D-D line.
Figure 3A:
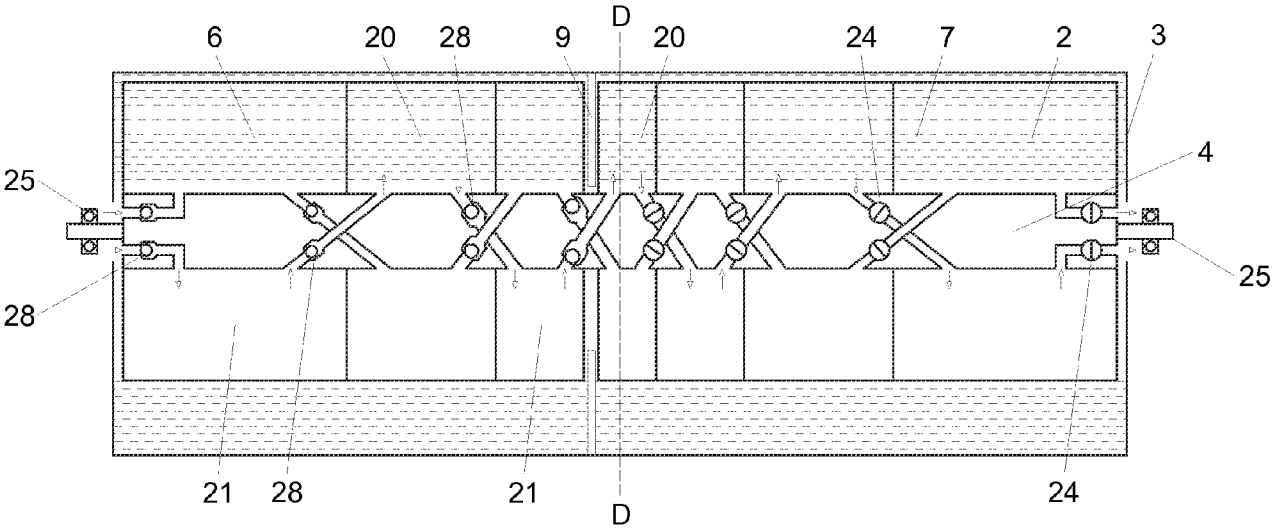
FIG. 3(A) shows a side view.

FIG. 3A and FIG. 3B show a third embodiment of the liquid ring system adapted to a Brayton-type engine or heat pump. This embodiment provides for a serial Brayton cycle application, which allows continuous compression by gas cells 12 in the first chamber 6 and continuous expansion by cells 12 in the second chamber 7 simultaneously, and facilitates timing of check valves 28 and liquid ports 24. FIG. 3A shows a cross-section of the rotor 4 corresponding to a point in the 360° cycle of the rotor 4. The liquid ports 24*a-b* from compressing gas cells 12*a-b* are closing (see, e.g., valve 24*a* in FIG. 3B), while the liquid ports 24*c-d* from expanding cells 12*c-d* are opening (see, e.g., valve 24*d* in FIG. 3B), assuming the rotor 4 is rotating clockwise in FIG. 3B. The check valves (e.g., 28*a*) in chamber 6 are opening and closing in sequence, depending on the pressure in the corresponding cell (e.g., cell 12*a*). A gas in the compressing gas cell 12*a* is compressed and delivered to the expanding gas cell 12*b*, which in turn becomes a compression cell. The gas in cell 12*b* then expands in sequence through cell 12*c* and the connected cells in chamber 7 as the liquid ports open 180° and close 180° of the 360° cycle of the rotor 4 to regulate the gas flow through the liquid ring system. The arrows indicate movement of the gas from one gas cell 12 to another gas cell 12 during a 360° cycle of the rotor 4. The first chamber 6 is cooled by chilled water, outside air, or the like. The fluid in the second chamber 7 may contain liquid salt or other suitable fluid, and may be heated by an external heat source (not shown in the drawing). A crucial element in the liquid ring adapted for an open cycle Brayton engine and open cycle Stirling engine is the liquid ports 24. FIG. 3B shows the cross-section of third embodiment along the D-D line. The rotor 4 of this embodiment has fluid connections 13 with check valves 28.

Figure 4:
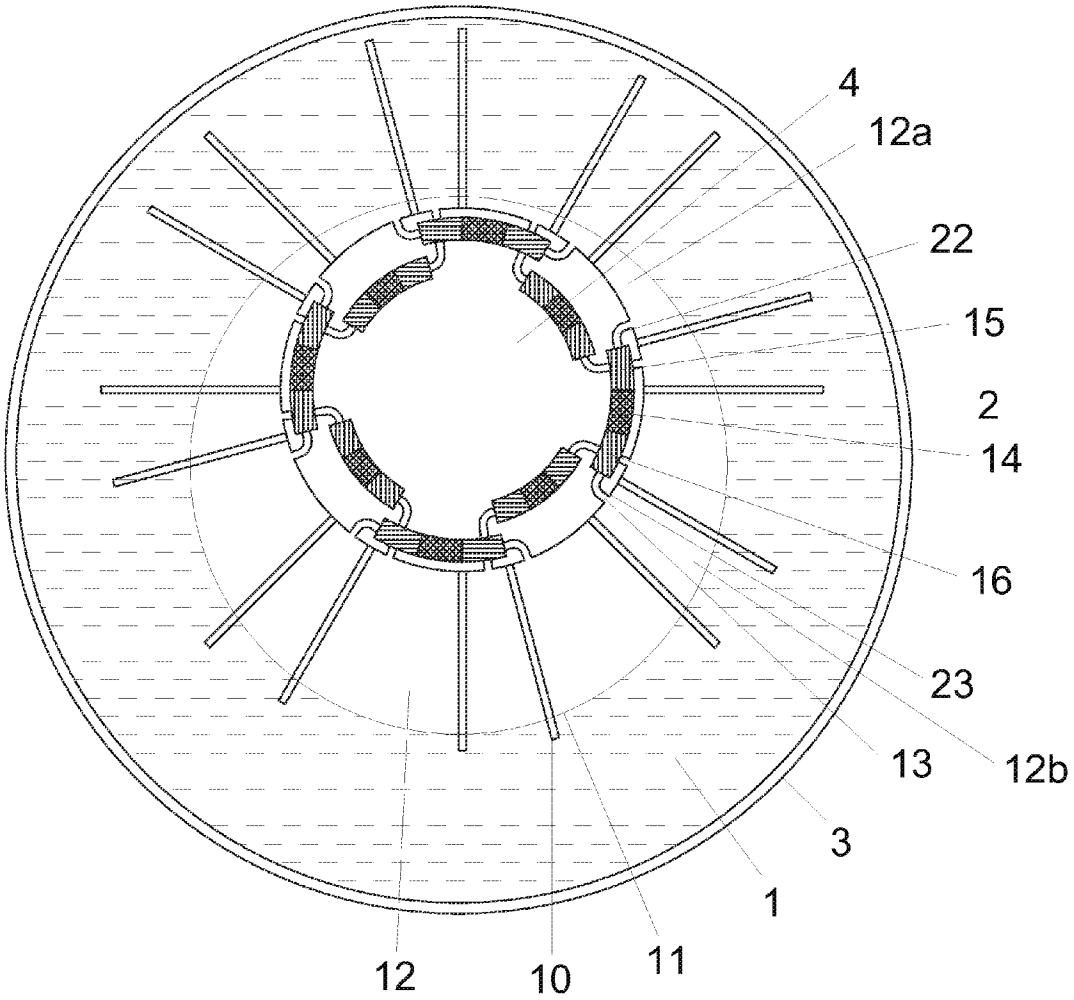
FIG. 4 shows a fourth embodiment of a liquid ring system according to the invention with one liquid-ring chamber, adapted for application to a closed-cycle Stirling-type engine from a top cross-sectional view.

FIG. 4 shows a fourth embodiment of a liquid ring system adapted to a closed-cycle Stirling type engine. The embodiment shows the top cross-sectional view of the engine. The main difference between the adapted Brayton-type engine and the adapted Stirling type engine is the presence of a regenerator 14. In this embodiment, the rotor 4 has a first heat exchanger 15 and a second heat exchanger 16 sandwiching a regenerator 14 inside the rotor chamber. The gas in the expansion cell 12*a* travels through the fluid connection 13, via the first heat exchanger 15, the regenerator 14, and the second heat exchanger 16 to the compression cell 12*b*. These two cells have a phase difference between 0° and 180° (e.g., about 90° in the embodiment shown in FIG. 4).

Figure 5B:
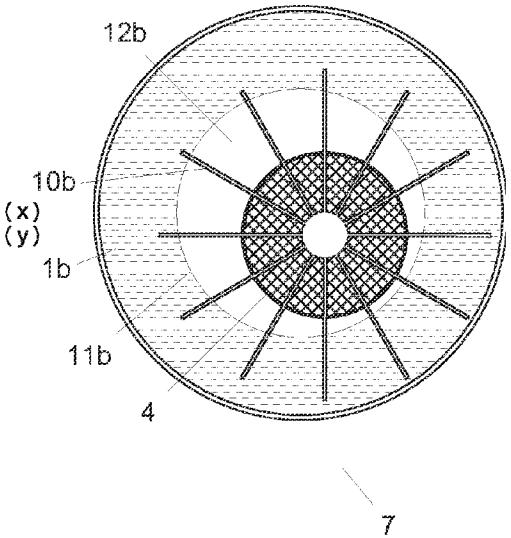
FIG. 5(B) shows a cross-sectional view along the F-F line.
Figure 5A:
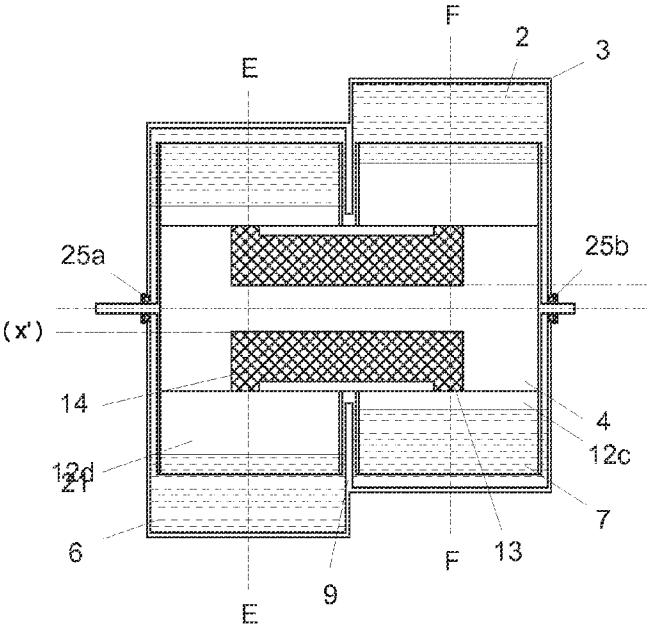
FIG. 5(A) shows a side view.
Figure 5C:
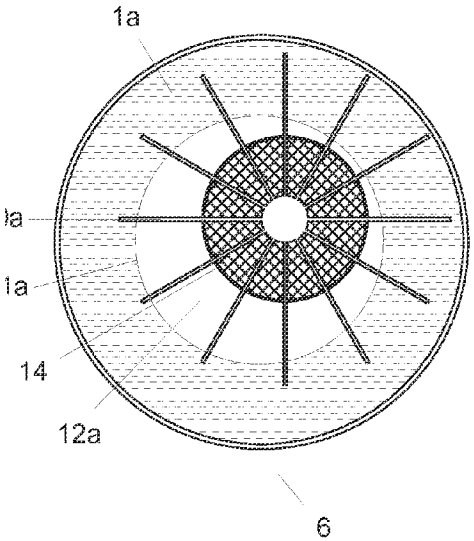
FIG. 5(C) shows a cross-sectional view along the E-E line.

FIG. 5 shows a fifth embodiment of a liquid ring system according to the invention, with two liquid-ring chambers arranged eccentrically to each other, adapted for application to a Stirling-type engine. FIG. 5(A) shows a side view of the liquid ring system. FIG. 5(B) shows a cross-sectional view along the F-F line of FIG. 5(A), and FIG. 5(C) shows a cross-sectional view along the E-E line of FIG. 5(A). The liquid ring system of FIG. 5 includes liquid rings 1*a* and 1*b*, a casing or housing 3, a fluid 2, a rotor 4, a regenerator 14, first and second cylindrical chambers 6 and 7 with symmetrical axes x and x' displaced from each other, a fixed wall 9 separating the fluid 2 in each of the chambers, impeller blades 10*a-b*, liquid-gas surfaces 11*a* and 11*b* in the respective chambers, gas cells 12*a-d*, a rotation axis y, bearings 25*a-b*, and a fluid connection 13 for gas in a compression cell 12*c* to travel through the regenerator 14 to an expansion cell 12*d*.

Figures 6A, 6B, 6C, 6D:
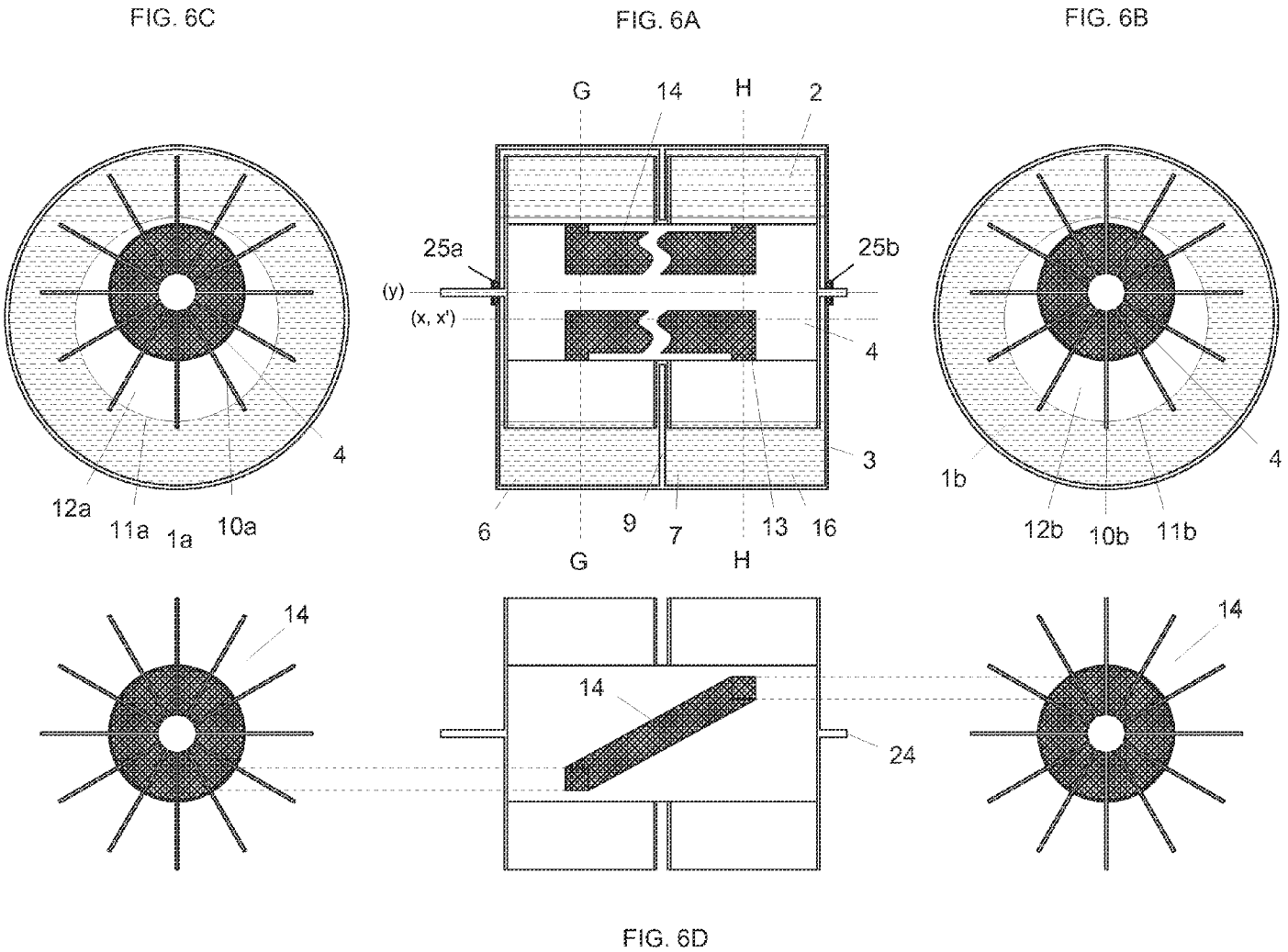
FIG. 6(A) shows a side view.
FIG. 6(B) shows a cross-sectional view along the H-H line.
FIG. 6(C) shows a cross-sectional view along the G-G line.
FIG. 6(D) shows a side view of the rotor shaft with an illustration of a fluid connection.

FIG. 6 shows a sixth embodiment of a liquid ring system according to the invention, with two liquid-ring chambers arranged coaxially to each other, and fluid connections at a 90° phase difference, extending along and helically around the axis of a rotor shaft, adapted for application to a Stirling-type engine. FIG. 6(A) shows a side view of the liquid ring system. FIG. 6(B) shows a cross-sectional view along the H-H line of FIG. 6(A), and FIG. 6(C) shows a cross-sectional view along the G-G line of FIG. 6(A). FIG. 6(D) shows a side view of the helical shaft of rotor 4 and illustrating a fluid connection 13. The liquid ring system of FIG. 6 includes liquid rings 1*a* and 1*b*, a casing or housing 3, a fluid 2, a rotor 4, a regenerator 14, first and second cylindrical chambers 6 and 7 with symmetrical axes x and x' displaced from the rotation axis y, a fixed wall 9 separating the fluid 2 in each of the chambers, impeller blades 10*a-b*, liquid-gas surfaces 11*a* and 11*b* in the respective chambers, gas cells 12*a-b*, bearings 25*a-b*, and a fluid connection 13 for gas in a compression cell to travel through the regenerator 14 to an expansion cell.

Figures 7A, 7B, 7C, 7D:
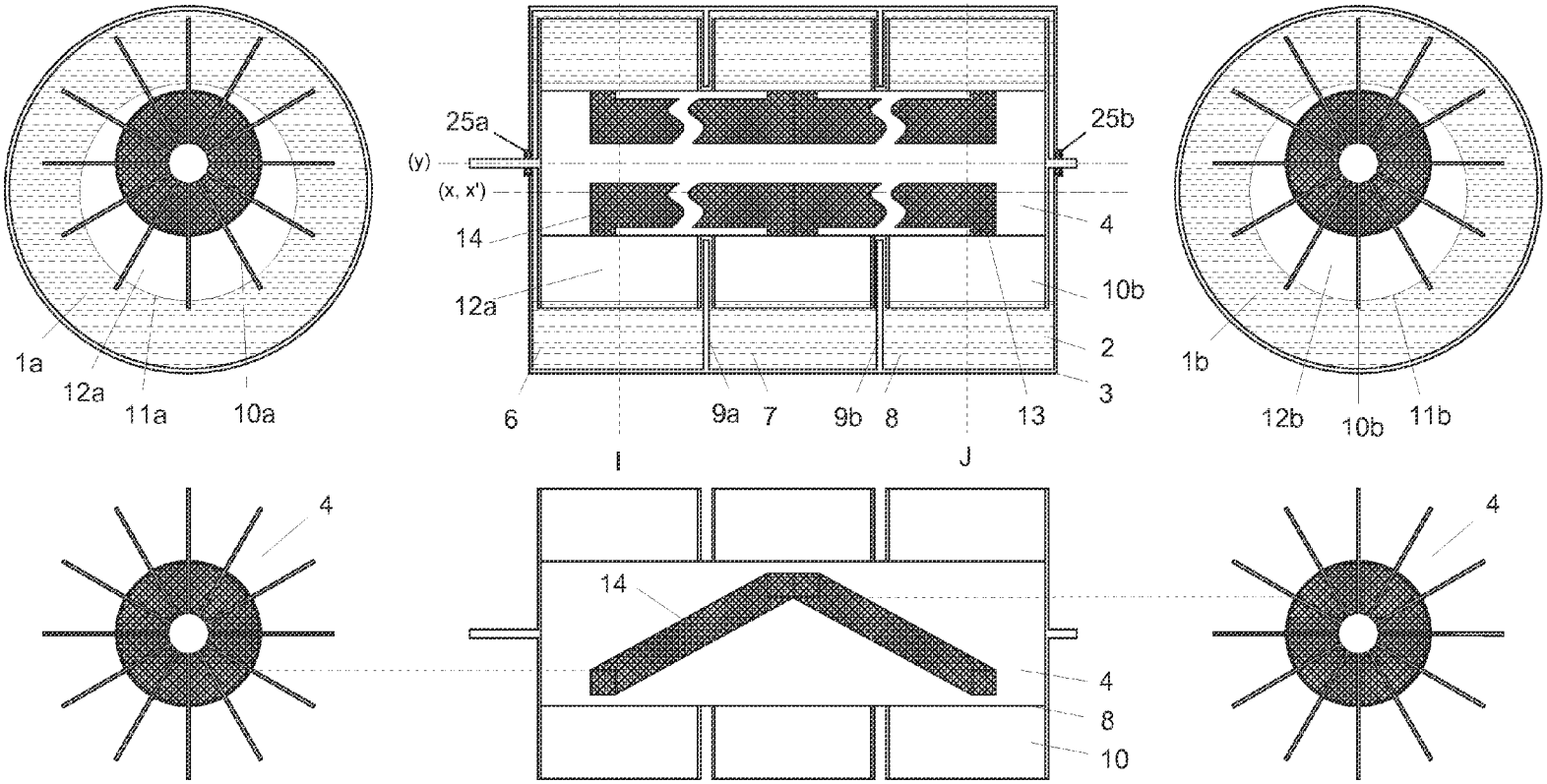
FIG. 7(A) shows a side view.
FIG. 7(B) shows a cross-sectional view along the J-J line.
FIG. 7(C) shows a cross-sectional view along the I-I line.
FIG. 7(D) shows a side view of the rotor shaft with an illustration of two fluid connections.

FIG. 7 shows a seventh embodiment of a liquid ring system according to the invention, with three liquid-ring chambers arranged coaxially to each other, and fluid connections at a 90° phase difference, extending along and helically around the axis of a rotor shaft, adapted for application to a Stirling-type engine or a Vuilleumier heat pump. FIG. 7(A) shows a side view of the liquid ring system. FIG. 7(B) shows a cross-sectional view along the J-J line of FIG. 7(A), FIG. 7(C) shows a cross-sectional view along the I-I line FIG. 7(A), and FIG. 7(D) shows a side view of the shaft of the rotor 4, illustrating two fluid connections 13 (see FIG. 7(A)). The liquid ring system of FIG. 7 includes liquid rings 1*a* and 1*b*, a casing or housing 3, a fluid 2, a rotor 4, a regenerator 14, first, second and third cylindrical chambers 6, 7 and 8 with symmetrical axes x and x' displaced from the rotation axis y, fixed walls 9*a-b* separating the fluid 2 in each of the chambers, impeller blades 10*a-b*, liquid-gas surfaces 11*a* and 11*b* in two of the chambers, gas cells 12*a-b*, a rotation axis y, bearings 25*a-b*, and fluid connections 13*a-b* for gas in a compression cell to travel through the regenerator 14 to an expansion cell.

Figure 8A:
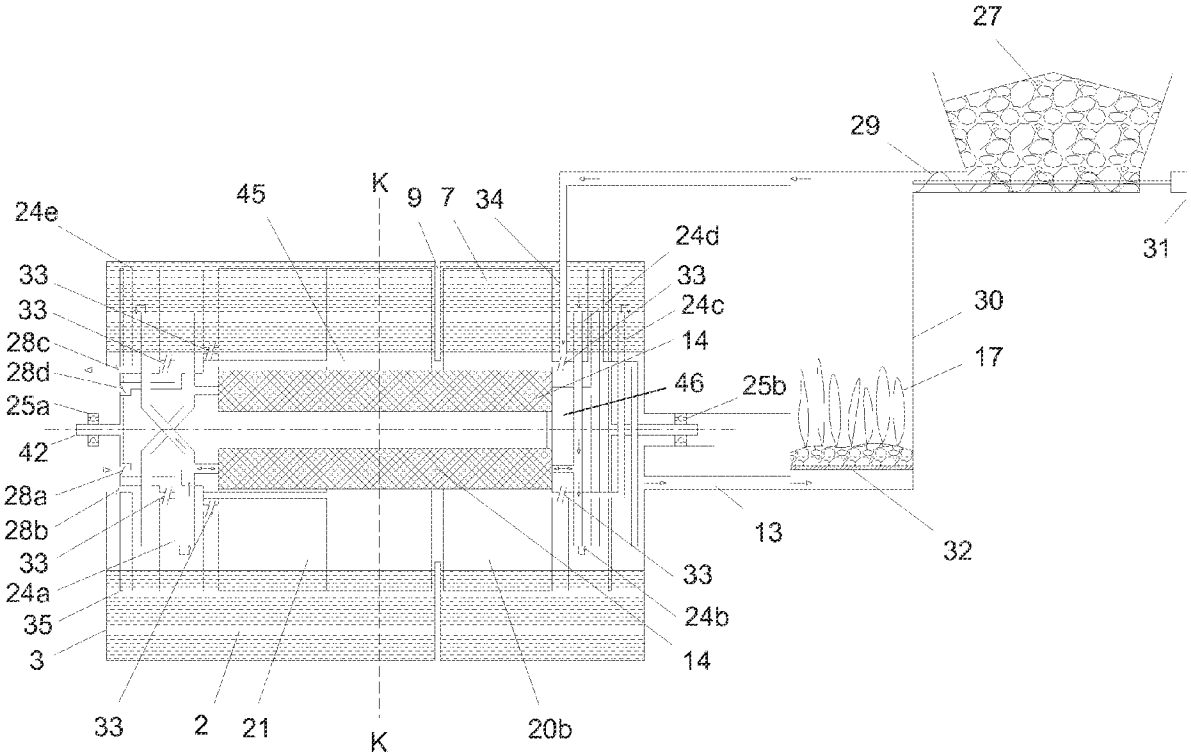
FIG. 8(A) shows a side view.
Figure 8B:
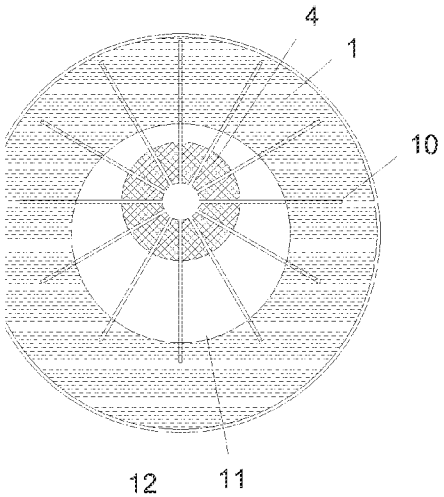
FIG. 8(B) shows a cross-sectional view along the K-K line.

FIG. 8 shows an eighth embodiment of a liquid ring system according to the invention, with two liquid-ring chambers arranged coaxially to each other, adapted for application to an open-cycle Stirling-type engine including an extended heat source. The double bars 33 indicate that the connection is similar, but with a 90° phase shift perpendicular to the plane of the drawing. Air is drawn into the compression cell 21 from outside through a check valve 28*a* when the cell gas volume expands. The air is compressed and flows through the liquid port 24*a* to the regenerator 14. The air is then heated when it flows through the regenerator 14. The heated air then flows through the liquid port 24*b* into the cell 20. The hot air expands in cell 20 and flows out through liquid port 24*c* and, via the fluid connection 13, through the hearth 32 of the combustion chamber 30. The gas is heated in the combustion chamber 30 and drawn by the spool cell 45 through the gas connection 34 into chamber 46. The hot gas passes through the liquid port 24*d*, then into and through the regenerator 14 in the opposite direction from before. The hot gas cools down when it flows through the regenerator 14. The cool gas from the regenerator 14 is further drawn by the spool cell 45 through the liquid port 24*e* and expelled to the outside through the check valve 28*b*. The liquid ring system of FIG. 8A includes a liquid ring 1, a casing 3, a fluid 2, a rotor 4, a fixed wall 9 separating cooling water and hot molten liquid salt, a vane or impeller blade 10, a liquid-gas surface 11, a gas cell 12, a rotation axis 42, liquid ports 24*a-e*, bearings 25, check valves 28*a-d*, a screw feeder 29, biomass or garbage fuel 27, a feeder motor 31, a regenerator 14, and a rotating wall 35.

Figure 9A:
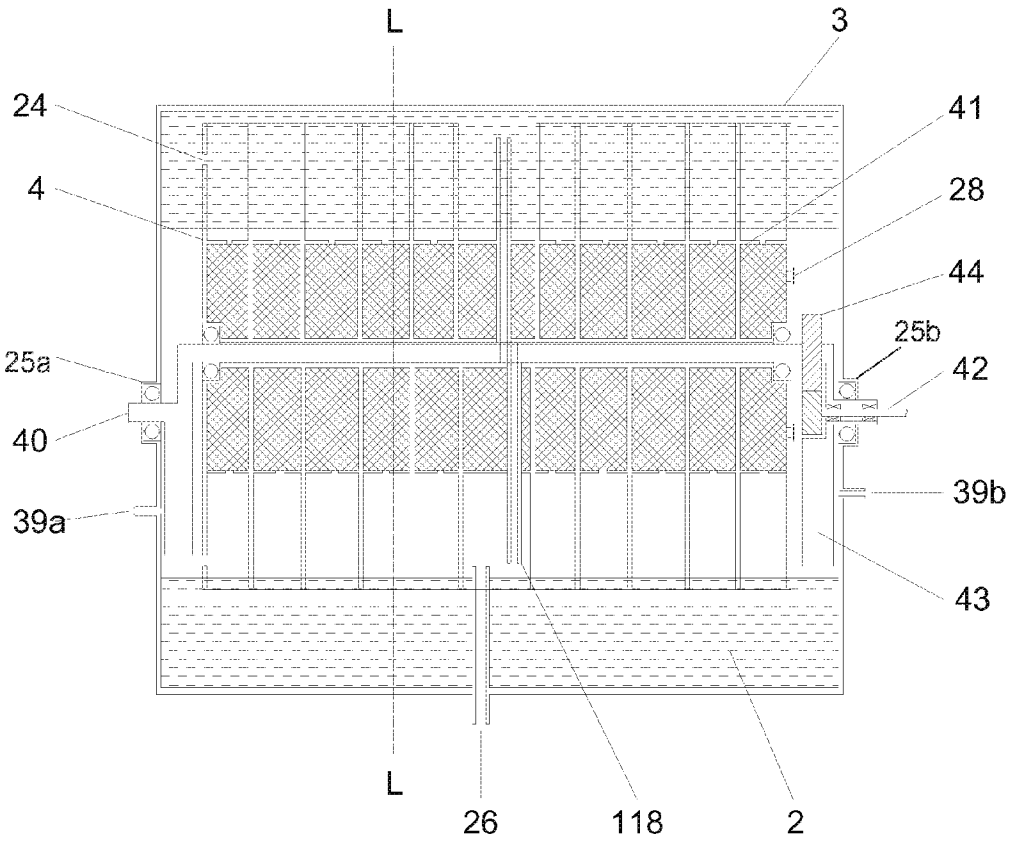
FIG. 9(A) shows a side view.
Figure 9B:
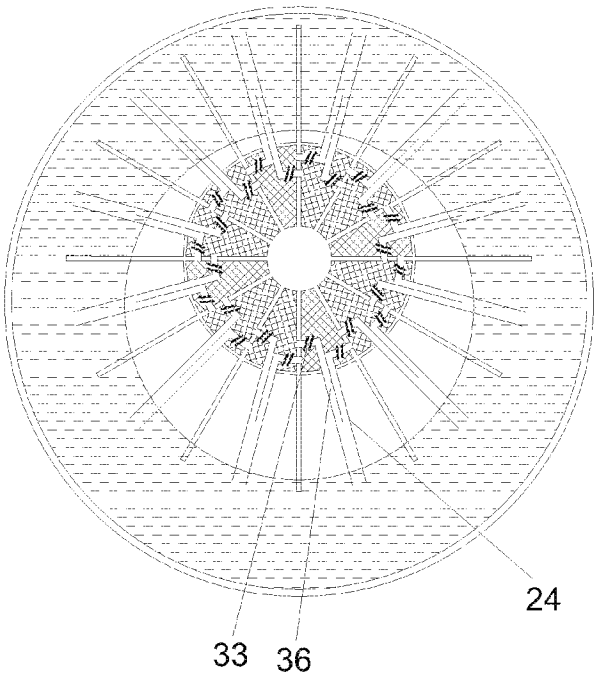
FIG. 9(B) shows a cross-sectional view along the L-L line.

FIG. 9 shows a ninth embodiment of a liquid ring system according to the invention with one liquid-ring chamber, adapted for PSA applications. FIG. 9(A) is a side view of the liquid ring system, and FIG. 9(B) is a cross-sectional view of the liquid ring system of FIG. 9(A) along the L-L line. In conventional gas separation installation, the energy for gas compression is a major cost. The system comprises a PSA gas separator with planetary movement, including a liquid port 24, a counterweight 43, an inlet 26 for raw gas, outlets 39*a-b* for gas component(s), bearings 25*a-b*, a rotor 4, a drive axis 40 for the planetary drive, a liquid 2, a PSA matrix 41, a check valve port 28 for exhausting less absorbed gas component(s), a gear 44, a drive axis 42 of the rotor 4, a rotating housing 3, and connections 33 to another cell in another section.

In planetary movement, the axis of rotation of the rotor moves around the rotation axis of the liquid ring. In a preferred embodiment, the rotation axis of the liquid ring and the rotation axis of the rotor are parallel. In planetary movement, there are two angular velocities $\omega_1$ and $\omega_2$, and two radius vectors $R_1$ and $R_2$. The distance $R_1$ between said rotation axes is the eccentricity. The radius of the rotor is $R_2$. $\omega_1$ is the angular velocity of $R_1$, and $\omega_2$ is the angular velocity of $R_2$. $\epsilon$ is the minimum distance between tip of the rotor and the inner wall of the casing. The radius of inner space containing the liquid ring is at least $R1+R2+\epsilon$. For clockwise rotation, $\omega_1$ and $\omega_2>0$. If $\omega_2=0$, no pumping occurs, i.e. like the moon always showing the same side towards the earth. If $\omega_2\neq0$, pumping occurs. The rotational speed of the liquid ring is approximately the same as the tip speed of the rotor (i.e., approximately $\omega_1[R_1+R_2]+\omega_2R_2$). With this device, the frequency of the reciprocal movement of said liquid piston can be regulated independent of the liquid ring speed. This system makes it possible to keep the speed of the liquid ring at optimal speed to keep friction as low as possible and at the same time keep a sufficient pressure gradient (created by centrifugal force) to seal the gas in the cells. In some applications (e.g., PSA), it is desirable to have a low pump frequency, since the absorbent needs some time to absorb and desorb the gas. In other applications, it is desirable to have a high pump frequency with low liquid velocity (e.g., when minimal losses due to friction and a high volume of pumped fluid are desired).

Figure 10A:
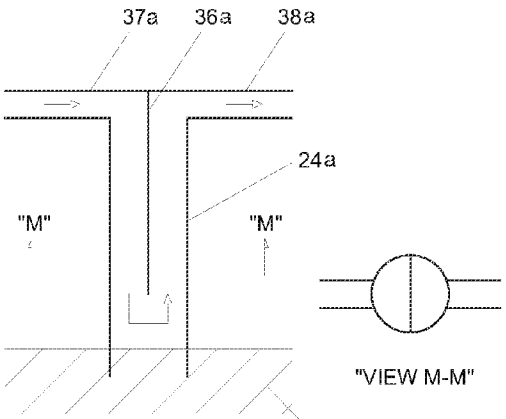
FIG. 10(A) shows a cross-sectional view of a first liquid port valve in an open position.
Figure 10B:
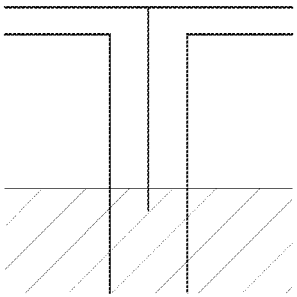
FIG. 10(B) shows a cross-sectional view of the first liquid port valve in a closed position.
Figure 10C:
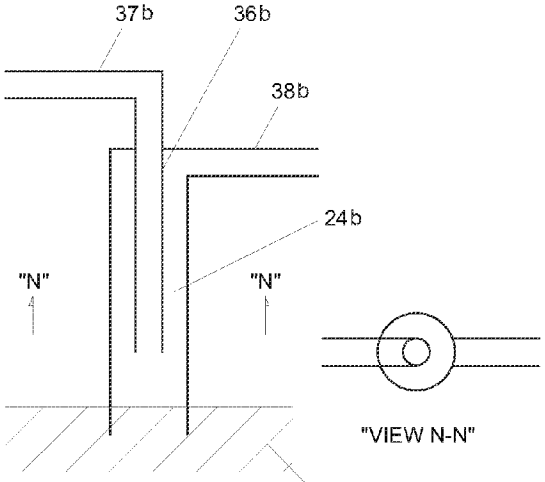
FIG. 10(C) shows a cross-sectional view of a second liquid port valve in an open position.
Figure 10D:
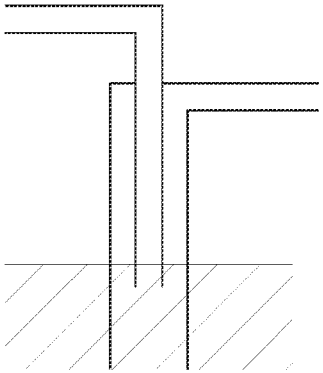
FIG. 10(D) shows a cross-sectional view of the second liquid port valve in a closed position.

FIGS. 10A-D show a tenth embodiment of a liquid ring system according to the invention, adapted for application as liquid port valves. A crucial element in the liquid ring open cycle Stirling engine and liquid ring Brayton device is the small volume liquid ports in FIG. 10. The small volume liquid port 24*a* of FIGS. 10A and 10B comprises a tube divided by a wall 36*a* with an entrance tube 37*a* and an exit tube 38*a*. The small volume liquid port 24*b* of FIGS. 10C and 10D comprises a small tube 36 inside a bigger one, with an entrance tube 37*b* and an exit tube 38*b*. The open end of each tube 24*a* and 24*b* is always submerged in the liquid 2. Typically, the wall 36*a* (FIGS. 10A and 10B) or the end of the small tube 36*b* (FIGS. 10C and 10D) is halfway between the highest level of liquid 2 and the lowest level of liquid 2. At the other end, one tube of the valve 24 is connected to one cell and the other tube of the valve 24 is connected to another cell. In FIG. 10A and FIG. 10B, the entrance tube 37*a* is connected to one cell, and the exit tube 38*a* is connected to another cell. In FIG. 10C and FIG. 10D, the big tube is connected to one cell through the exit tube 38*b*, and the small tube (i.e., the entrance tube 37*b*) is connected to another cell. The reciprocating liquid works as a small volume liquid port with free gas flow (i.e., an "open" status) during the low liquid level (FIGS. 10A and 10C) and no gas flow (i.e., a "closed" status) during the high liquid level (FIGS. 10B and 10D).

The liquid ring system according to the invention has an inventive concept based on conventional liquid ring systems, but which provides some different elements and requires a different operation. In a preferred embodiment, the liquid ring system has a first cylindrical chamber and a second cylindrical chamber, each of which has an impeller and a plurality of cells formed between the impeller vanes. Further, the system has at least one cell in the first chamber in fluid connection with at least one cell in the second chamber. More specifically, the fluid connection is made between the positive displacement spaces of the at least one cell in the first chamber and the at least one cell in the second chamber at a phase difference of $\alpha$ degrees, wherein $\alpha>0$. Such a fluid connection is particularly advantageous when made between all of the cells available in both chambers, because each pair of cells can be utilized, which provides for an efficient operation for the liquid ring system.

In another embodiment of the invention, the geometric axis of the first chamber is radially displaced in relation to the geometric axis of the second chamber, and the fluid connection is formed by a passage of liquid extending essentially in an axial direction between the cells in the first and second cylindrical chambers. In another embodiment of the invention, the geometric axis of the first cylindrical chamber is common to the geometric axis of the second cylindrical chamber, and the fluid connection is formed by a passage of liquid extending helically between the cells in the first and second cylindrical chambers. Thus, a phase difference $\alpha$ may be achieved, either 90°, 180° or any value in the range between 45° and 180°.

With reference to the casing, it may be closed, such that the liquid and gas are maintained under an elevated pressure in the first and second cylindrical chambers with respect to the ambient pressure. A heat exchanger may be arranged between the cells of the first cylindrical chamber and the cells of the second cylindrical chamber, for heat transfer between the liquid and the gas in the cells. The heat exchanger may comprise a plurality of liquid spray nozzles and/or heat conducting plates.

The casing may further comprise a third cylindrical chamber having a liquid therein and a rotor that may comprise a plurality of third impeller blades forming a plurality of cells in the third cylindrical chamber, wherein at least a first cell in the second cylindrical chamber may be in fluid connection with a cell in the third cylindrical chamber with $\alpha$ degrees of phase difference, wherein $\alpha>0°$ (e.g., $\alpha=90°$ or 180°). Therefore, the device may form a combination of a heat engine and a heat pump as one unit (e.g., a single or integrated unit).

The cylindrical chambers may have a common symmetrical axis, and the housing may rotate or be arranged to rotate around the common symmetrical axis. Liquid rings may be formed by this arrangement during operation of the device, independent of the impeller blades.

The fluid may comprise water, a saline solution, a gas ($H_2$, He, $NH_3$, air, argon, etc.), a gas fluid, $CO_2$, combinations of $CO_2$ and an organic liquid having a melting point less than −78° C., a cryogenic liquid (e.g., liquid air, liquid nitrogen, a Freon, etc.) and/or a high temperature liquid (e.g., a molten salt [for example, NaCl, KCl, KBr, NaF, $BeF_2$, $NaNO_3$, $KNO_3$, a combination thereof, etc.] or molten metal [Hg, Al, Zn, Cd, an alkali metal, Mg, Ag, Au, Sn, Pb, Ga, In, alloys thereof such as galinstan, woodsmetal, etc.]).

Preferred embodiments of liquid ring devices have been described. However, the person skilled in the art realizes that these embodiments may be varied within the scope of the appended claims without departing from the inventive idea. All of the described alternative embodiments above, or parts of an embodiment or embodiments, may be freely combined without departing from the inventive idea as long as the combination is not contradictory.

In various embodiments, the liquid ring device may include at least one liquid ring impeller, and at least one cell in the liquid ring impeller comprises another positive displacement space. Cells formed by the same impeller may be in fluid connection, and cells formed by different impellers may be in fluid connection and have a common axis of rotation. In a further embodiment, several impellers may be in the same liquid ring, and the impellers may form cells in fluid connection.

Cell pairs with a connection may be part of an open loop Stirling device with ports. In some liquid ring devices, the ports are open at an angle of a cycle of the device. In one exemplary liquid ring device, at least one of the ports is a liquid port. Further liquid ring devices according to various embodiments comprise a plurality of liquid ports, where the liquid ports are in separate liquid ring sections.

In the present liquid ring device, at least one cell pair may be adapted for a pressure swing adsorption (PSA) application. In any of the embodiments, cells in fluid connection may have a different size. In further embodiments of the liquid ring device, cells in fluid connection may be adapted for a 180° phase difference.

In the liquid ring device, several impellers on a rotor with cells in fluid connection may be in separate cylindrical spaces with separate liquid rings. In any of the embodiments, the liquid ring device may have a rotating housing.

In some embodiments, at least one cell in fluid connection with another cell may have a minimum volume of gas in a phase difference to a minimum volume of the other cell. In various examples, the phase difference is more than 0° (e.g., 90° or 180°).

The liquid ring device may include a connection between two cells that contains a heat exchanger, where a gas exchanges heat with an external heat source or heat sink. In some embodiments, the heat exchanger in the liquid ring device may contain (i) a first fluid that comprises water, brine, or $CO_2$, (ii) a low temperature liquid, and/or (iii) a high temperature liquid. The low temperature liquid may comprise liquid air or liquid nitrogen, for example, and the high temperature liquid may comprise a molten salt or a molten metal.

An engine may comprise a liquid ring device according to any of the embodiments. The engine may operate by having internal combustion where fuel is supplied into at least one cell, or alternatively, by external combustion. The fuel may comprise methane or biomass, for example. An exemplary liquid ring 4 stroke engine may comprise an engine according to embodiments of the invention, having a circular liquid ring section and an oval impeller section.

In various embodiments of the liquid ring device, the heat exchanger may comprise fluid spray nozzles and/or heat conducting plates for heat transfer between fluid in the cells. An exemplary liquid ring device may contain at least one cell with a molecular sieve for PSA (Pressure Swing Adsorption), and in particular, where the connection contains a molecular sieve for PSA. Various embodiments of a liquid ring parametric PSA device comprise a liquid ring device according to this paragraph, having more than 3 cells in fluid connection, where a feed gas is supplied to an intermediary cell, a less adsorbed gas is withdrawn from one or more of the cells at one end of the rotor, and a more adsorbed gas is withdrawn from one or more of the cells at the other end of the rotor. Further embodiments of the liquid ring parametric PSA device may contain a number of cells that depends on the molecular sieve and on the purity of the withdrawn gas.

In exemplary liquid ring devices including an impeller, the impeller may have (i) an axis that conducts movement in a circle in a plane perpendicular to the axis, (ii) a rotation speed that may be adjusted independent of a peripheral speed of the liquid ring, the peripheral speed of the liquid ring being adapted to a working pressure in the cell, and (iii) a cycle frequency that can be adjusted to an adsorption speed of the molecular sieve.

What is claimed is:

1. A liquid ring system comprising;

a housing;

a rotor mounted inside said housing; and a liquid ring inside said housing and engaged by said rotor, said liquid ring comprising a liquid and having an inner gas-liquid surface, and said rotor having a number of gas cells defined in part by the liquid in the liquid ring, and at least one wall of each of said gas cells consisting of a part of the inner gas-liquid surface of said liquid ring;

wherein said part of the inner gas-liquid surface performs a radial reciprocating movement relative to an axis of rotation of said rotor;

at least one of said gas cells is in fluid connection with at least a positive displacement space integrated with or formed at least in part by said rotor; and a plurality of the gas cells are in cell to cell gas connection in a chain with at least one other gas cell of said number of gas cells, the plurality of gas cells having a phase difference of between 0° and ±180°, inclusive of ±180°, between minimum gas volumes of the gas cells in cell to cell gas connection.

2. The system of claim 1, wherein said rotor performs a planetary movement, said axis of rotation of the rotor moves around the rotation axis of said liquid ring, and a pump frequency of said rotor varies independent of the liquid ring speed.

3. The system of claim 1, wherein said housing contains at least two separate liquid rings, with liquid sealed gas cells in cell to cell gas connection with at least one other liquid sealed gas cell.

4. The system of claim 1, wherein at least one of said gas cells and/or a connector between connected ones of said gas cells comprises a regenerator, a gas in said at least one of said gas cells and/or said connector exchanges heat with (i) the regenerator and/or (ii) at least one heat exchanger, and the gas further exchanges heat with an external heat source, an internal heat source, a heat sink and/or a molecular sieve.

5. The system of claim 4, wherein said heat exchanger comprises external heat transfer flanges on said housing, fluid spray nozzles in said cell, heat conducting plates for heat transfer between fluid and the gas in said cells, and/or membranes of metal, rubber or plastic that transfer heat between fluid and the gas.

6. The system of claim 5, wherein said heat exchanger comprises said membranes of metal, rubber or plastic, and said membranes of metal, rubber or plastic hinder vapor from the fluid from contaminating the gas.

7. The system of claim 4, wherein said system functions as a Stirling device and comprises a compression cell, a first heat exchanger connected to a heat sink, a regenerator, a second heat exchanger connected to a heat source, and an expansion cell, wherein said Stirling device functions as a heat engine when a temperature of the heat source is higher than a temperature of the heat sink, and as a heat pump when the temperature of the heat source is lower than the temperature of the heat sink.

8. The system of claim 4, wherein the cell to cell gas connection comprises ports that are open at an angle of a cycle of said system.

9. The system of claim 8, operating as an internal combustion engine having the first and second cells with said cell to cell gas connection being part of an open loop Stirling device with said ports.

10. The system of claim 1, wherein said system functions as a Brayton engine, a gas is compressed, heated in a heat chamber and expanded by flowing through a number of said gas cells in cell to cell gas connection in series, and said cell to cell gas connections comprise check valves, mechanical valves or liquid ports.

11. The system of claim 1, wherein said system functions as a Rankine engine or heat pump.

12. The system of claim 1, comprising at least three gas cells in serial cell to cell gas connection, with a hot expansion space and a cold expansion space in fluid connection with a common compression space, and the system works as a heat driven heat pump.

13. The system of claim 1, further comprising a liquid port comprising a gas cell with a reciprocating liquid surface and at least two cell to cell gas connections in the chain having a free pathway between the connections at a first angle of rotation of the rotor and a closed pathway between the connections at a second angle equal to 360° minus said first angle of rotation.

14. The system of claim 1, wherein the gas cells in cell to cell gas connection that have the minimum gas volume have a difference in an angle of rotation of 180°.

15. The system of claim 1, wherein a gas in said gas cells comprises air, and said system further comprises a combustion chamber that heats said air and that has a fuel addition mechanism that adds said fuel to said combustion chamber.

16. The system of claim 15, operating as an internal combustion engine using a fuel supplied into said at least one gas cell or into said cell to cell gas connection.

17. The system of claim 1, wherein the cell to cell gas connection comprises ports that are open during about half of the cycle of said system.

18. The system of claim 1, wherein said liquid includes water, $CO_2$, $H_2$, He, $NH_3$, argon, liquid nitrogen, a Freon, liquid air, a molten salt or a molten metal.

19. A liquid ring parametric pressure swing adsorption (PSA) system, comprising the system of claim 1 and a molecular sieve, wherein the cell to cell gas connection comprises ports that are open at an angle of a cycle of said system, each of said plurality of as cells is in cell to cell gas connection in series with said at least one other gas cell, a feed gas is supplied to an intermediary cell, a less adsorbed gas is withdrawn from one or more of the gas cells at one end of the rotor, and a more adsorbed gas is withdrawn from one or more of the gas cells at another end of the rotor.

20. The PSA system of claim 19, wherein a number of the plurality of gas cells in cell to cell gas connection in the series depends on the molecular sieve and on a purity of the withdrawn gas.

* * * * *